United States Patent [19]

Johansson

[11] 4,432,737

[45] Feb. 21, 1984

[54] STEERING ARRANGEMENT AT INBOARD-OUTBOARD DRIVE UNIT

[75] Inventor: Donald Johansson, Älta, Sweden

[73] Assignee: Bröderna Lindqvists Verkstäder AB, Bandhagen, Sweden

[21] Appl. No.: 345,730

[22] Filed: Feb. 4, 1982

[30] Foreign Application Priority Data

Oct. 2, 1981 [SE] Sweden ..... 8100921

[51] Int. Cl.[3] ..... B63H 5/13

[52] U.S. Cl. ..... 440/60; 440/58

[58] Field of Search ..... 440/53, 55, 56, 57, 440/58, 59, 60, 61, 62, 63; 74/89.18, 498

[56] References Cited

U.S. PATENT DOCUMENTS

| | | | |
|---|---|---|---|
| 1,339,454 | 5/1920 | Hall | 74/498 |
| 1,689,962 | 10/1928 | Peck | 440/55 |
| 2,114,633 | 4/1938 | Hedges | 440/55 |
| 2,912,955 | 11/1959 | Leipert | 440/55 |
| 3,946,698 | 3/1976 | LaFollette et al. | 440/61 |

FOREIGN PATENT DOCUMENTS

| | | | |
|---|---|---|---|
| 1424 | of 1862 | United Kingdom | 440/59 |

*Primary Examiner*—Trygve M. Blix
*Assistant Examiner*—Rodney Corl
*Attorney, Agent, or Firm*—Sherman & Shalloway

[57] ABSTRACT

The invention relates to a steering arrangement for boats equipped with inboard-outboard drive (10). The gearbox (22) of the drive is arranged so as not to be horizontally pivotal in relation to the stern (12) of the boat, while the underwater housing (26) of the drive is horizontally pivotal in relation to the gearbox (22). For rotating the underwater housing in relation to the gearbox, a steering gear (44–56) acts which comprises a toothed segment (56). Hereby a total steering angle of up to 180° can be obtained.

3 Claims, 2 Drawing Figures

STEERING ARRANGEMENT AT INBOARD-OUTBOARD DRIVE UNIT

This invention relates to an arrangement for steering a boat equipped with a propulsion device in the form of an inboard-outboard drive unit, at which the propulsive power is transmitted from the engine via a universal joint to the gearbox of the inboard-outboard drive and from there to an underwater housing, to which the propeller is attached, and where the gearbox and underwater housing can be tilted vertically in relation to the stern of the boat.

Conventional inboard-outboard drive units normally have a steering mechanism, the rotation centre of which extends through the driving universal joint, which there also serves as a joint for the steering. The steering capacity, consequently, is limited, usually to a total steering angle of 60° to 90°. As a result thereof, maneuvering problems arise in narrow passages and at berthing on minimum space.

The present invention, therefore, has the object to provide a new arrangement for steering an inboard-outboard drive unit, which arrangement renders possible a substantially improved steering capacity, with a total steering angle of up to 180°.

This object is achieved in that the invention has been given the characterizing features defined in the attached claims.

Figure 1:
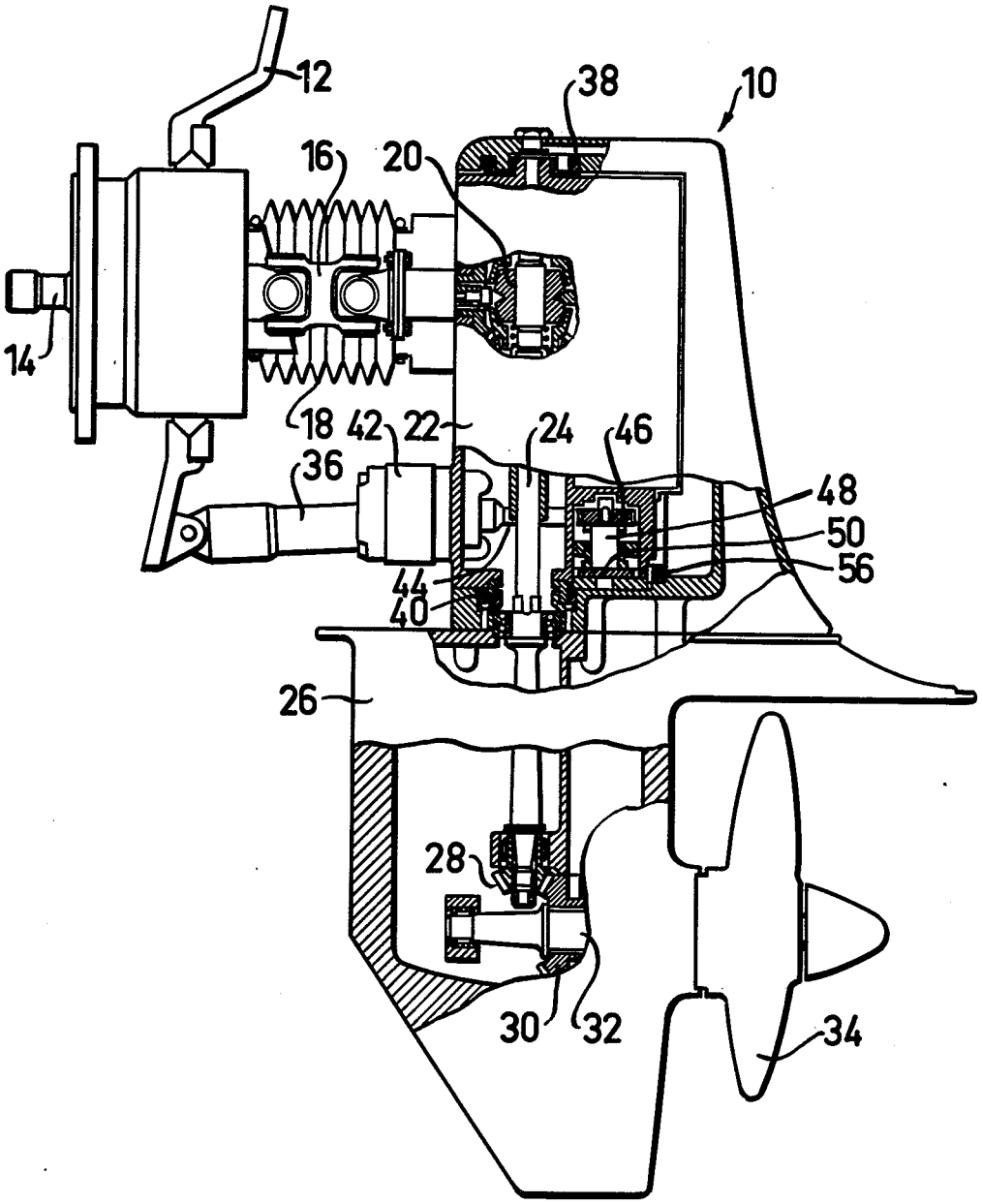
Figure 2:
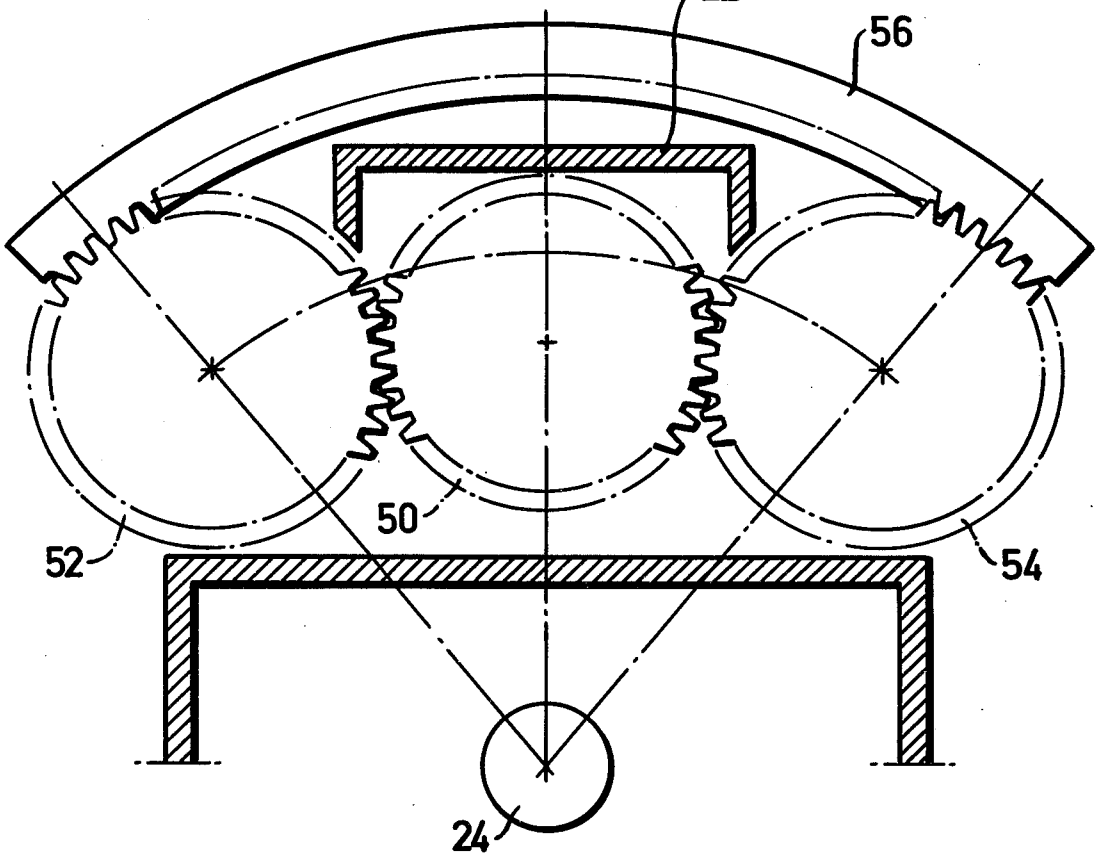

The invention is described in greater detail in the following, with reference to an embodiment shown in the accompanying drawing, in which FIG. 1 is a schematic vertical section through an inboard-outboard drive equipped with a steering arrangement according to the invention, and FIG. 2 is a schematic horizontal section through the steering gear transmitting the rotation.

FIG. 1 shows an inboard-outboard drive 10 mounted on a boat with a stern 12. Inboard the boat an engine (not shown), preferably a conventional internal combustion engine, is located. From this engine extends a driven shaft 14, which is supported, in a manner not shown in detail, near the stern 12 of the boat. The power in this shaft 14 is transmitted via a universal joint 16, which outwardly is enclosed by a bellows 18, to a miter gear 20 located in the upper part of the gearbox 22 of the inboard-outboard drive. In said miter gear 20, the transmission direction of the power is changed from having been substantially horizontal to a substantially vertical power transmission direction. This power transmission in vertical direction is effected by means of a drive shaft 24, which passes through one end wall of the gearbox 22 and continues into an underlying underwater housing 26, where the drive shaft 24 terminates in the form of a bevel gear 28, which meshes with a second bevel gear 30 secured on a propeller shaft 32, on which the propelling propeller 34 is mounted.

The gearbox 22 and underwater housing 26 together are tiltable in vertical direction in relation to the stern 12 of the boat, so that the propeller 34 can be lifted out of the water. Between the stern and the gearbox two hydraulically operated tilt cylinders 36 are located for adjusting the trim position of the drive 10 in relation to the stern 12 of the boat. According to the invention, the gearbox 22 of the inboard-outboard drive is arranged so as not to be pivotal horizontally relative to the stern 12 of the boat. The underwater housing 26, however, can be pivoted horizontally in relation to the stern 12 and also to the gearbox 22. The underwater housing 26 is rotatable about a substantially vertical axis, which coincides with the centre line of the drive shaft 24, and is supported on the gearbox 22 at the upper and, respectively, lower side thereof by means of bearing 38,40.

For rotating the underwater housing 26 in relation to the gearbox 22, a worm screw 44 driven by a hydraulic motor 42 is located in the lower part of the gearbox and meshes with a worm gear 46. Said worm gear 46 is mounted on the same shaft 48 as a gear 50. On each side of said gear 50, as appears from FIG. 2, a gear 52 and, respectively, 54 are located, which are of identical design and mesh with the gear 50. Upon rotation of the gear 50, the gears 52 and 54 are caused to rotate in the same direction of rotation, which is opposed to that of the gear 50. This entire gear arrangement is located in the lower part of the gearbox 22. Of the two outer gears 52,54, however, at least one always meshes with a toothed segment 56 rigidly mounted in the underwater housing 26. When the boat is to be steered, the hydraulic motor 42 is actuated in a suitable way, for example by means of a servo system, by turning the steering wheel of the boat. The hydraulic motor rotates the worm screw 44, which forces the worm gear 46 to rotate. Said worm gear is mounted on the same shaft as the central gear 50, so that also this gear, and therewith the two outer gears 52, 54 meshing with the central gear 50 are rotated. Upon rotation of one of the outer gears 52,54, the toothed segment 56 is moved in either direction, and thereby also the underwater housing 26 with the propelling propeller 34 is driven in the desired direction. The toothed segment 56 preferably covers an angle of at least 90°, and the outer gears 52,54 are arranged so that, when the steering is in straight position, both these gears 52,54 mesh with the toothed segment. When the toothed segment 56 is moved in either direction, it rolls off from one of the gears 52,54 and meshes only with the other one thereof. When the steering has been returned to neutral position, the segment again meshes with the gear, from which it had rolled off previously.

Due to the fact that at steering the toothed segment 56 cooperates with one of the outer gears 52,54, at a toothed segment angle of about 90° a total steering deflection of about 180° is obtained, whereby the gear transmission transmitting the steering requires very little space. In addition to the large steering deflection, the steering arrangement according to the invention yields a steering, which is very accurate, self-braking and, owing to the high gear ratio, requires relatively little steering power.

What I claim is:

1. An assembly for steering a boat equipped with a propulsion device in the form of an inboard-outboard drive (10), to which the propulsive power from the engine is transmitted by a universal joint (16) to the gearbox (22) of the inboard-outboard drive and from there to an underwater housing (26), to which the propeller (34) is attached, and where the gearbox (22) and underwater housing (26) can be tilted vertically in relation to the stern (12) of the boat, and the gearbox (22) is arranged as not to be horizontally pivotal relative to the stern (12) of the boat, while the underwater housing (26) is horizontally pivotal relative to the gearbox (22) by means of a steering gear (44–56) acting between the gearbox (22) and the underwater housing (26), characterized in that the steering gear comprises a first actuated gear (50) meshing with two outer gears (52, 54), one on each side of said first gear (50), said first gear and two outer gears being located in the gearbox (22), and that at least one of said outer gears (52, 54) meshes with a toothed circular segment (56) having a length which covers an angle of about 90° so as to allow a steering deflection of about 180°, the toothed segment (56) being located in the underwater housing (26).

2. The assembly as defined in claim 1, wherein said first gear (50) is located on the same shaft (48) as a worm gear (46), driven by a worm screw (44) operated by a hydraulic motor (42).

3. The assembly as defined in claim 1 or 2, wherein the toothed segment (56) meshes with both the outer gears (52, 54) when the steering gear is in a straight-ahead position.

* * * * *

UNITED STATES PATENT AND TRADEMARK OFFICE

CERTIFICATE OF CORRECTION

PATENT NO. : 4,432,737

DATED : February 21, 1984

INVENTOR(S) : DONALD JOHANSSON

It is certified that error appears in the above-identified patent and that said Letters Patent is hereby corrected as shown below:

On the title page,
Priority Date, delete "Oct. 2, 1981" and insert --

February 10, 1981 --.

Signed and Sealed this

*Sixth* Day of *November 1984*

[SEAL]

*Attest:*

GERALD J. MOSSINGHOFF

*Attesting Officer*

*Commissioner of Patents and Trademarks*